United States Patent [19]

Kobayashi

[11] 4,385,977

[45] May 31, 1983

[54] APPARATUS FOR ELECTROPLATING A METAL WIRE OF RELATIVELY LOW ELECTRIC CONDUCTIVITY

[76] Inventor: Masami Kobayashi, 3-13-15, Hachimanyama, Setagaya-ku, Tokyo, Japan

[21] Appl. No.: 369,081

[22] Filed: Apr. 16, 1982

[30] Foreign Application Priority Data

Nov. 25, 1981 [JP] Japan ..... 56-187789

[51] Int. Cl.[3] ..... C25D 7/06; C25D 13/00; C25D 13/16

[52] U.S. Cl. ..... 204/206

[58] Field of Search ..... 204/206, 207, 208, 209, 204/210, 211, 28

[56] References Cited

U.S. PATENT DOCUMENTS

| | | | |
|---|---|---|---|
| 2,477,808 | 8/1949 | Jones | 204/211 |
| 3,483,113 | 12/1969 | Carter | 204/206 |
| 3,900,383 | 8/1975 | Austin et al. | 204/28 X |

FOREIGN PATENT DOCUMENTS

| | | | |
|---|---|---|---|
| 620451 | 5/1961 | Canada | 204/206 |

*Primary Examiner*—G. L. Kaplan
*Assistant Examiner*—Nam X. Nguyen
*Attorney, Agent, or Firm*—Armstrong, Nikaido, Marmelstein & Kubovcik

[57] ABSTRACT

The present invention relates to an apparatus for electroplating a metal wire of a relatively low electric conductivity. Said wire is wound onto a cylindrical frame which connects said wire to a cathode at many contact points which are changed at certain intervals by a rocking motion.

5 Claims, 3 Drawing Figures

APPARATUS FOR ELECTROPLATING A METAL WIRE OF RELATIVELY LOW ELECTRIC CONDUCTIVITY

BACKGROUND OF THE INVENTION

The present invention relates to an apparatus for electroplating a metal wire of a relatively low electric conductivity, especially to an apparatus for electroplating a stainless steel wire with gold.

Many wire leads for electronic devices are conventionally made of Phosphor Bronze or Beryllium Bronze which are excellent in the electric conducting property. Recently, the need has arisen to use such wire leads for communicating a minimum electric current, which requires such wire leads to provide mechanical resilience as well as electric conductivity. Thus, wire leads of Phosphor Bronze or Beryllium Bronze must be formed relatively thick.

Stainless steel, as is well known, is excellent in mechanical resilience. Therefore, it is advantageous for wire leads for the above mentioned use to be made of relatively fine or ultrafine stainless steel electroplated with gold, which wire leads may be formed so that they are small in size.

Stainless steel, however, has greater electric resistance compared to copper so that it is very difficult to electroplate stainless steel with gold continuously over a long term at a uniform density.

SUMMARY OF THE INVENTION

It is an object of the present invention to provide an apparatus for electroplating a metal wire of a relatively low electric conductivity, which metal wire is electroplated at a uniform density.

The above object is attained by an apparatus for electroplating a metal wire of a relatively low electric conductivity, said wire being wound around a cylindrical frame means which is adapted to be dipped in an electroplating solution which is electrically connected to a positive pole of an electric source, said frame means comprising, according to the invention, a plurality of frame elements adapted for being connected to a negative pole of the electric source, said frame elements extending parallel to a center axis of said cylindrical frame means to form a substantial cylindrical outer surface onto which said wire is wound so as to directly contact each of said frame elements, means for rocking each of said frame elements about an axis parallel to said center axis in order that contact points can be changed between said frame elements and said wire, and means for supporting said frame elements to permit said rocking motion.

Further features and advantages of the present invention will become apparent from the following description with reference to the attached drawings, in which.

DESCRIPTION OF A PREFERRED EMBODIMENT

Figure 1:
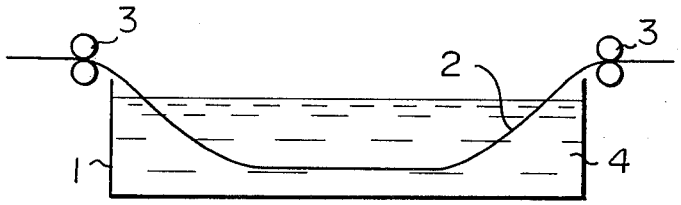
Fig. 1 PRIOR ART
FIG. 1 shows a schematic side view of a conventional apparatus for continuous electroplating.

Referring to FIG. 1, a conventional electroplating apparatus is shown. The numeral 1 designates a electroplating bath container in which a wire 2 is passed continuously through rollers 3 and dipped in an electroplating solution 4, as is well known for those skilled in the art. The rollers 3 are connected electrically to a negative pole, so that the wire 2 is electroplated on its surface. However, if the wire 2 is made of stainless steel, the electric current reaches only a small portion of the stainless steel wire 2 which is near the rollers, due to its high electric resistance, and the intermediate portion between the two rollers 3 is not electrically affected. Thus, there is no point in having the wire 2 extend for a longer distance in the electroplating solution 4.

Figure 2:
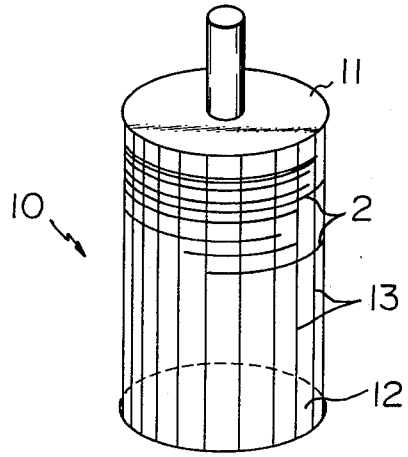
FIG. 2 shows a perspective view of a cylindrical frame, according to the present invention.

Now referring to FIG. 2, there is provided a cylindrical frame 10 which is adapted to be dipped in an electroplating solution (not shown, but any conventional bath means can be used) which is electrically connected to a positive pole of an electric source.

The cylindrical frame 10 consists of a pair of circular support element 11, 12 which are opposed to each other to form the end faces of the cylindrical frame 10, and a plurality of frame elements 13 which extend parallel to a center axis of the cylindrical frame 10 to form a substantial cylindrical outer surface onto which the wire 2 is wound, so that the wire 2 directly contacts the frame elements 13. Each of the frame elements 13 is electrically connected to a negative pole of the electric source.

Figure 3:
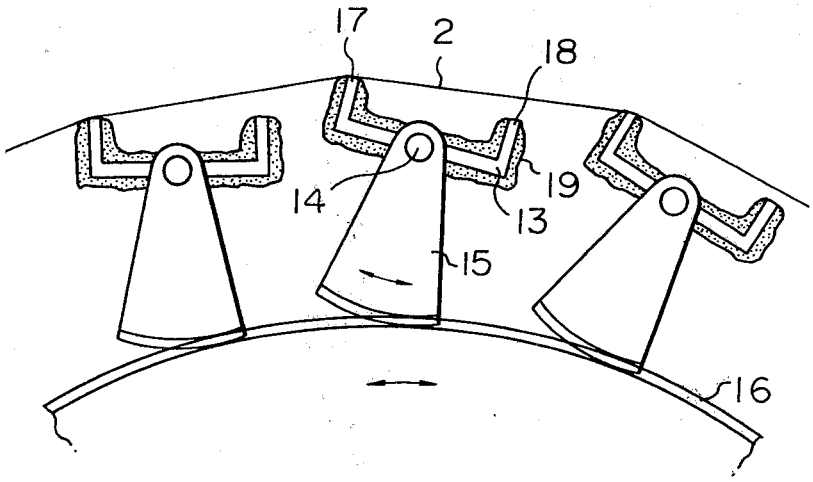
FIG. 3 shows a detailed end view of the cylindrical frame in FIG. 2, for illustrating the frame elements and their rocking motion, with the support element deleted.

Referring to FIG. 3, the frame elements 13 and rocking means for each of the frame elements 13 are shown in the cylindrical frame 10. The cross section of each of the frame elements 13 is U-shaped, the end portions 17, 18 of which contact the wire 2 alternately by the hereinafter described rocking motion. Each of the U-shaped frame elements 13 is coated with a shield material 19, except for the two top surfaces 17, 18. At the bottom center of the "U", each of the frame elements 13 is fixedly supported on a shaft 14 which also extends parallel to the center axis of the cylindrical frame 10 and is rotatably secured to the support elements 11, 12 (not shown in FIG. 3) at both ends.

For rocking each of the frame elements 13, sector gears 15 are fixed to the respective shafts 14, a tooth of the sector gears 15 being oriented to the center axis of the frame 10 and mating with a large center gear 16, the axis of which coincide with the center axis of the frame 10. The center gear 16 is rotated by a suitable mechanism (not shown).

In operation, the wire 2 is wound onto the cylindrical frame 10 so that it is in contact with one of the two end surfaces 17, 18, and the cylindrical frame 10 then is dipped in the electroplating solution 4. Subsequently, electroplating is started by applying an electric voltage between the anode, which is dipped in the solution, and the cathode, which is connected to the wire 2 through the frame elements 13. As the wire 2 is electrically connected to each of the frame elements 13 at short distances, which are determined by the distance between one end 17 or 18 of each frame element 13 and that of the adjacent frame element 13, the electric voltage reaches all of the wire 2, even if the wire has a high electric resistance. Thus a stainless steel wire of a considerable length can be electroplated with gold, or any other material, at a uniform density. During such an operation, a rocking motion is effected by actuating the center gear 16 in alternate directions, as shown by the arrow in FIG. 3, at certain intervals, by which the frame elements 13 rock to change their contact points from one end surface to the other, for example from the end 17 to the end 18. This is very advantageous to prevent gold from precipitating at particular portions.

Further, it is advantageous to oscillate the cylindrical frame 10 so that the contact points between the wire 2 and the frame elements 13 is changed, thereby the uniform plating layer can be obtained over the whole length of stainless steel wire.

I claim:

1. An apparatus for electroplating a metal wire of a relatively low electric conductivity, said wire being wound onto a cylindrical frame means which is adapted to be dipped in an electroplating solution which is electrically connected to a positive pole of an electric source, said frame means comprising:

a plurality of frame elements adapted for being connected to a negative pole of the electric source, said frame elements extending parallel to a center axis of said cylindrical frame means to form a substantial cylindrical outer surface onto which said wire is wound so as to directly contact each of said frame elements;

means for rocking each of said frame elements about an axis parallel to said center axis in order that contact points can be changed between said frame elements and said wire;

and means for supporting said frame elements to permit said rocking motion.

2. An apparatus according to claim 1, wherein each of said frame elements has a U-shaped cross section having two ends which alternately contact said wire by said rocking motion.

3. An apparatus according to claim 2, wherein each of said U-shaped frame elements is coated with a shield material allowing said end to directly contact said wires.

4. An apparatus according to claim 1, wherein said rocking means comprises a central gear, an axis of which coincides with said center axis of said cylindrical frame means, and sector gears, which are fixedly secured to the respective frame elements, each of said sector gears mating with said central gear.

5. An apparatus according to claim 1, wherein means for oscillating said cylindrical frame means is further provided.

* * * * *